US011134741B2

(12) United States Patent
Plunkett et al.

(10) Patent No.: US 11,134,741 B2
(45) Date of Patent: Oct. 5, 2021

(54) PROTECTIVE HELMET WITH A RETRACTABLE AND REMOVABLE VISOR

(71) Applicant: E.D. Bullard Company, Cynthiana, KY (US)

(72) Inventors: Matthew G. Plunkett, Lexington, KY (US); Travis J. Plumlee, Georgetown, KY (US); Bonnie J. McMurray, Lawrenceburg, KY (US); Joshua J. M. Haldeman, Cincinnati, OH (US); Pierre-Luc Lussier, Montreal (CA); Brendan Gallivan, Bristol, VT (US)

(73) Assignee: E.D. Bullard Company, Cynthiana, KY (US)

( * ) Notice: Subject to any disclaimer, the term of this patent is extended or adjusted under 35 U.S.C. 154(b) by 265 days.

(21) Appl. No.: 15/987,682

(22) Filed: May 23, 2018

(65) Prior Publication Data

US 2018/0338559 A1 Nov. 29, 2018

Related U.S. Application Data

(60) Provisional application No. 62/510,798, filed on May 25, 2017.

(51) Int. Cl.
*A42B 3/22* (2006.01)
*A42B 3/14* (2006.01)

(52) U.S. Cl.
CPC ..... *A42B 3/223* (2013.01); *A42B 3/14* (2013.01)

(58) Field of Classification Search
CPC ..... A42B 3/223; A42B 3/14; A42B 3/224; A42B 3/222; A42B 3/145; A42B 3/147
(Continued)

(56) References Cited

U.S. PATENT DOCUMENTS 4,287,615 A * 9/1981 Morin ..... A42B 3/22 2/424
4,546,498 A * 10/1985 Fantin ..... A42B 3/224 2/424

(Continued)

FOREIGN PATENT DOCUMENTS

CA 2542086 A1 4/2005
EP 2061352 B1 6/2011

(Continued)

OTHER PUBLICATIONS

Korean Intellectual Property Office, International Search Report and Written Opinion issued in corresponding Application No. PCT/US2018/034298, dated Sep. 12, 2018.

*Primary Examiner* — Alissa L Hoey
(74) *Attorney, Agent, or Firm* — Stites & Harbison, PLLC; David W. Nagle, Jr.; Gary N. Stewart

(57) ABSTRACT

A protective helmet adapted to receive and protect a head of a wearer comprises: an outer shell shaped to protect the head of the wearer, with the outer shell defining a bottom opening and an internal cavity for receiving the head of the wearer; a headband and a suspension positioned within the internal cavity of the outer shell; and a visor rotatable between a retracted position within the outer shell to an extended position in front of a face of the wearer, wherein the visor simultaneously rotates about a first pivot axis and a second pivot axis as it moves between the retracted position and the extended position. The visor can also be readily removed from the protective helmet and easily replaced should it become damaged.

4 Claims, 13 Drawing Sheets

(58) Field of Classification Search
USPC ..... 2/6.5, 416
See application file for complete search history.

(56) References Cited

U.S. PATENT DOCUMENTS

| | | | | | |
|---|---|---|---|---|---|
| 4,748,696 | A * | 6/1988 | Fohl | A42B 3/223 | 2/10 |
| 4,766,609 | A | 8/1988 | Lane | | |
| 4,887,320 | A * | 12/1989 | Long | A42B 3/226 | 2/424 |
| 5,283,914 | A * | 2/1994 | James | A42B 3/16 | 128/201.24 |
| 5,604,930 | A * | 2/1997 | Petit | A42B 3/22 | 2/424 |
| 5,752,280 | A * | 5/1998 | Hill | A42B 3/185 | 2/453 |
| 6,282,726 | B1 * | 9/2001 | Noyerie | A42B 3/226 | 2/424 |
| 6,609,254 | B2 | 8/2003 | Bielefeld et al. | | |
| 7,174,575 | B1 | 2/2007 | Scherer | | |
| 7,565,704 | B2 * | 7/2009 | Wu | A42B 3/145 | 2/410 |
| 8,286,270 | B2 * | 10/2012 | Higgins | G02B 27/0176 | 2/422 |
| 8,458,822 | B2 * | 6/2013 | Lee | A42B 3/223 | 2/424 |
| 8,555,424 | B2 | 10/2013 | Higgins | | |
| 8,813,270 | B2 * | 8/2014 | Pizzi | A42B 3/223 | 2/453 |
| RE45,459 | E * | 4/2015 | Hersick | A42B 3/12 | 2/5 |
| 9,032,548 | B2 * | 5/2015 | Isobe | A42B 3/222 | 2/6.3 |
| 9,125,447 | B2 * | 9/2015 | Lebel | A44B 17/0076 | |
| 9,277,780 | B2 * | 3/2016 | Hillion | A42B 3/225 | |
| 9,433,253 | B2 * | 9/2016 | McKinney | A42B 3/227 | |
| 9,788,592 | B2 * | 10/2017 | Cheng | A42B 3/222 | |
| 10,098,405 | B2 * | 10/2018 | Ross | A42B 3/18 | |
| 10,154,704 | B1 * | 12/2018 | Caito, III | A42B 3/223 | |
| 2001/0054188 | A1 * | 12/2001 | Guay | A42B 3/226 | 2/6.4 |
| 2004/0019956 | A1 * | 2/2004 | Arai | A42B 3/222 | 2/410 |
| 2007/0056071 | A1 * | 3/2007 | Smith | A42B 3/06 | 2/5 |
| 2007/0186324 | A1 * | 8/2007 | Sheldon | A42B 3/20 | 2/9 |
| 2008/0196148 | A1 * | 8/2008 | Morin | A42B 3/326 | 2/421 |
| 2008/0263754 | A1 * | 10/2008 | Folkesson | A61F 9/025 | 2/453 |
| 2009/0313745 | A1 * | 12/2009 | Kang | A42B 3/225 | 2/424 |
| 2010/0229288 | A1 * | 9/2010 | Higgins | A42B 3/185 | 2/422 |
| 2011/0072548 | A1 | 3/2011 | Hersick et al. | | |
| 2011/0154551 | A1 | 6/2011 | Spink | | |
| 2011/0277224 | A1 | 11/2011 | Okuma et al. | | |
| 2013/0191976 | A1 | 8/2013 | Pizzi | | |
| 2015/0033457 | A1 * | 2/2015 | Tryner | A42B 3/205 | 2/421 |
| 2016/0286890 | A1 | 10/2016 | Morin et al. | | |

FOREIGN PATENT DOCUMENTS

| | | | | |
|---|---|---|---|---|
| GB | 2576752 | A * | 3/2020 | A42B 3/225 |
| KR | 10-1660000 | B1 | 9/2016 | |
| WO | 1997019606 | A1 | 6/1997 | |
| WO | WO-2013110675 | A1 * | 8/2013 | A42B 3/222 |

* cited by examiner

PROTECTIVE HELMET WITH A RETRACTABLE AND REMOVABLE VISOR

CROSS-REFERENCE TO RELATED APPLICATIONS

The present application claims priority to U.S. Patent Application Ser. No. 62/510,798 filed on May 25, 2017, the entire disclosure of which is incorporated herein by reference.

BACKGROUND OF THE INVENTION

The present invention relates to a protective helmet.

Protective helmets are commonly worn in the workplace to prevent or reduce the likelihood of head injuries. For example, a hard hat is the most common and well-recognized protective helmet. For another example, a fire helmet is another common protective helmet. Such protective helmets, including hard hats and fire helmets, commonly are comprised of three primary components—an outer shell, a headband, and a suspension—which cooperate to reduce the potential for injury by attenuating some translational energy of the force of an impact to the helmet. Certain protective helmets, including fire helmets, sometimes also include an inner shell positioned between the outer shell and the suspension, which also aids in attenuating some translational energy of the force of an impact to the outer shell of the helmet Additionally, some protective helmets, are equipped with a visor or face protection shield that also protects the eyes and/or some portion of the face of the wearer. However, in prior art constructions, such visors or face protection shields are often not readily removable from the helmet, and, at least in some cases, may not be readily moveable from a retracted position within the helmet to an extended position in front of the face of a wearer.

SUMMARY OF THE INVENTION

The present invention is a protective helmet with a retractable and removable visor.

An exemplary protective helmet made in accordance with the present invention includes: a substantially rigid outer shell shaped to protect the wearer's head, with the outer shell defining a bottom opening and an internal cavity for receiving the wearer's head; a headband positioned in the outer shell near the bottom opening of the outer shell; and a suspension comprised of at least two straps and intersecting one another within the internal cavity of the outer shell. The headband and suspension cooperate to reduce the potential for injury by maintaining a distance between the outer shell and the head of the wearer and attenuating some translational energy of the force of an impact to the outer shell of the helmet.

In some embodiments, the protective helmet further includes an inner shell with a foam liner positioned between the outer shell and the suspension, which also aids in attenuating some translational energy of the force of an impact to the outer shell of the helmet. The headband and the straps of the suspension may be secured to the inner shell or the outer shell.

The protective helmet also includes a visor. In this regard, a visor refers to and includes any form of face protection shield that covers any portion of the eyes and/or face of the wearer. The visor is secured by multiple components that not only secure the visor to the outer shell of the protective helmet, but allow the visor to be readily moved from a retracted position within the outer shell of the helmet to an extended position outside of the outer shell and in front of the face of a wearer when the protective helmet is in use, or removed from the helmet altogether. Indeed, there are preferably two substantially identical assemblies of such components, one on each side of the protective helmet. Specifically, these assemblies are mirror images of one another on each side of the protective helmet. These components include: an anchor block, which is secured to the outer shell of the protective helmet, with the anchor block including a first cam and a second cam, which each extend from a lateral surface of an upstanding wall portion of the anchor block; a retainer including a groove for receiving and retaining a portion of the visor, and further including first and second elongated slots which define respective pathways for the first cam and the second cam of the anchor block; and a latch which is pivotally mounted to the retainer for selectively engaging the visor.

The retainer includes first and second elongated slots which, as mentioned above, define respective pathways for the first cam and the second cam of the anchor block. The retainer also preferably includes a groove, which is configured to receive a portion (i.e., a side edge) of the visor. The latch is then preferably pivotally mounted in an integral recess defined by the retainer. When a portion of the visor is received and retained in the groove defined by the retainer, the latch can be selectively pivoted into engagement with the visor. In this regard, the latch includes an integral ridge extending from its rear surface. When the latch is in a closed position, the integral ridge extending from the rear surface of the latch is positioned in a slot defined through the visor near its side edge. Thus, when the latch is in the closed position, the visor is locked into position within the groove defined by the retainer. However, when the latch is pivoted out of engagement with the visor (i.e., the integral ridge is withdrawn from the slot defined through the visor) into an open position, the visor can be withdrawn from the groove and removed from the retainer.

As mentioned above, the anchor block is secured to the outer shell of the protective helmet. The anchor block preferably includes an upstanding wall portion, with the first cam and the second cam each extending from a lateral surface of the upstanding wall portion. The first cam extending from the lateral surface of the upstanding wall portion of the anchor block is received in the first elongated slot of the retainer. Similarly, the second cam extending from the lateral surface of the upstanding wall portion of the anchor block is received in the second elongated slot of the retainer. Since the position of the anchor block is fixed relative to the outer shell of the protective helmet, the interaction of the respective first and second cams with the corresponding first and second elongated slots controls movement of the retainer, and thus the visor, with respect to the outer shell of the protective helmet.

As mentioned above, there are preferably two substantially identical assemblies of such components (which are mirror images of one another), one on each side of the protective helmet. Thus, the visor can be characterized as rotating simultaneously about a first pivot axis defined by the aligned first cams on the left and right sides of the protective helmet and a second pivot axis defined by the aligned second cams on the left and right sides of the protective helmet as the visor moves between the retracted position and the extended position. Because of this rotation along two axes, when it is rotated from the retracted position to the extended position, the visor is effectively extended forward (away from the face) before it drops down (in front of the face). Thus, the visor can be used over and in front of glasses, goggles, or other eye protection that may also be used by the wearer.

Additionally, because the visor can be readily removed by pivoting the latches out of engagement with the visor, the visor can be easily replaced should it become damaged.

DETAILED DESCRIPTION OF THE INVENTION

The present invention is a protective helmet with a retractable and removable visor.

Figure 1:
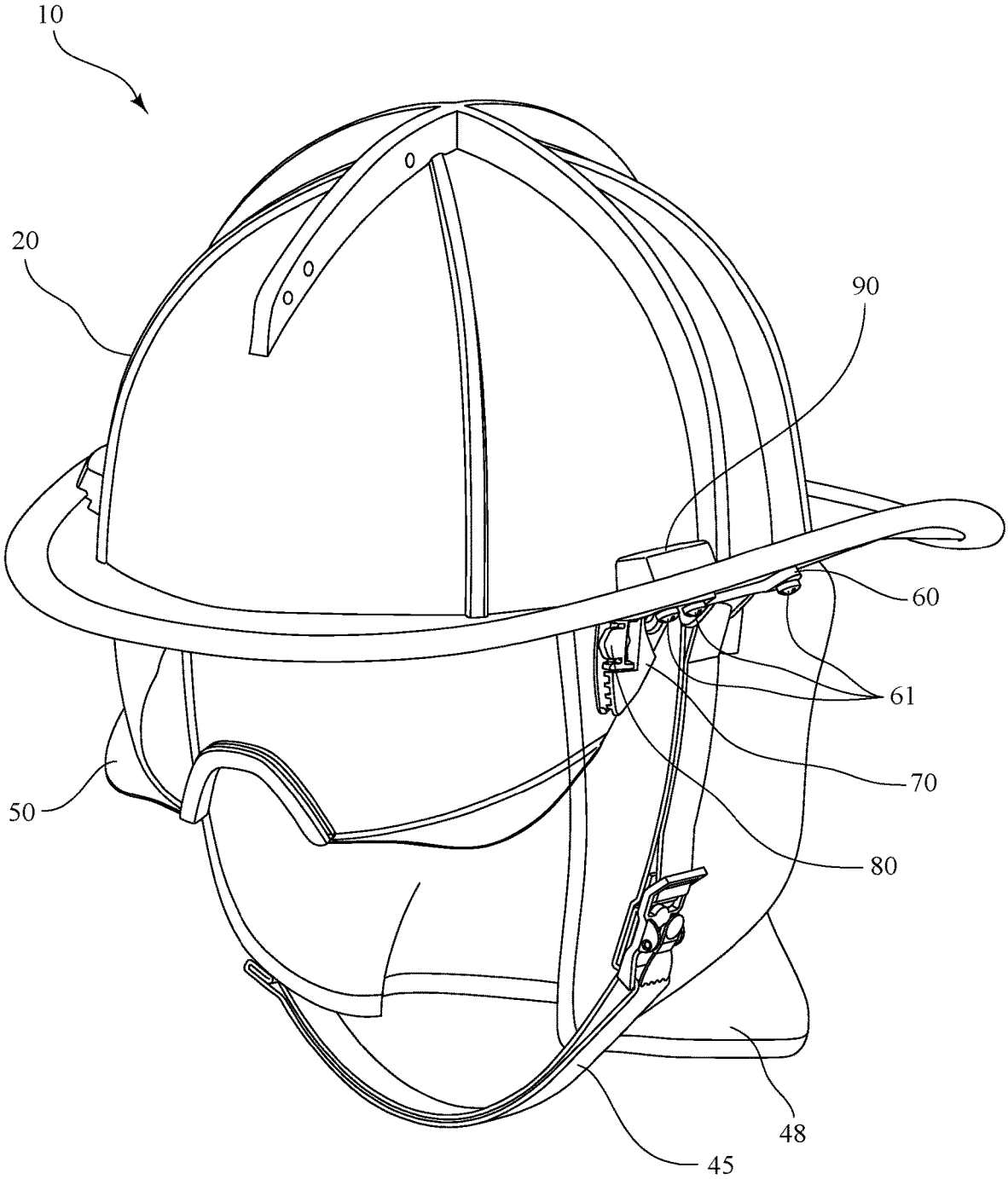
FIG. 1 is a perspective view of an exemplary protective helmet with a retractable and removable visor made in accordance with the present invention, with the visor in an extended position.
Figure 2:
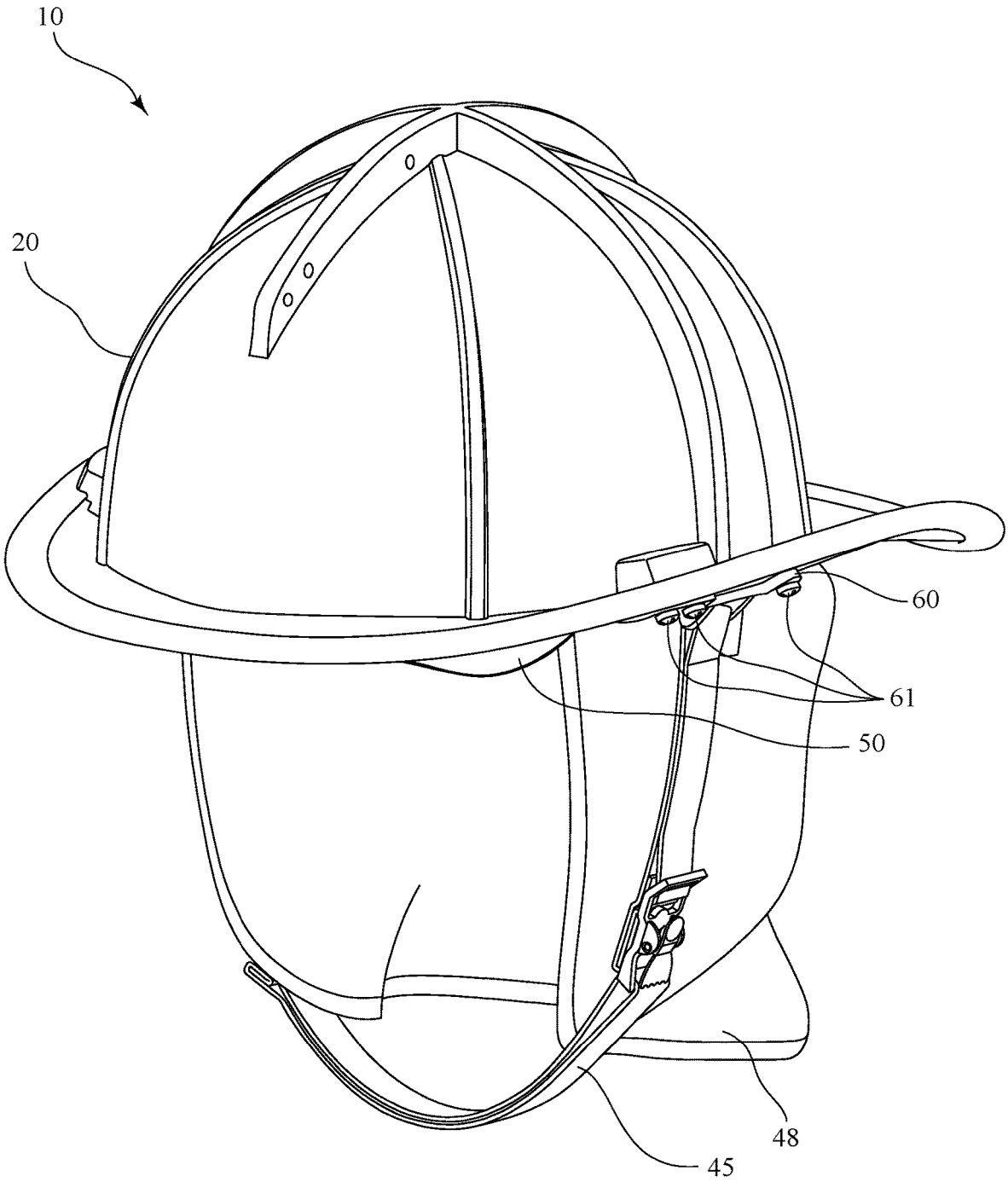
FIG. 2 is another perspective view of the exemplary protective helmet of FIG. 1, but with the visor in a retracted position.
Figure 3:
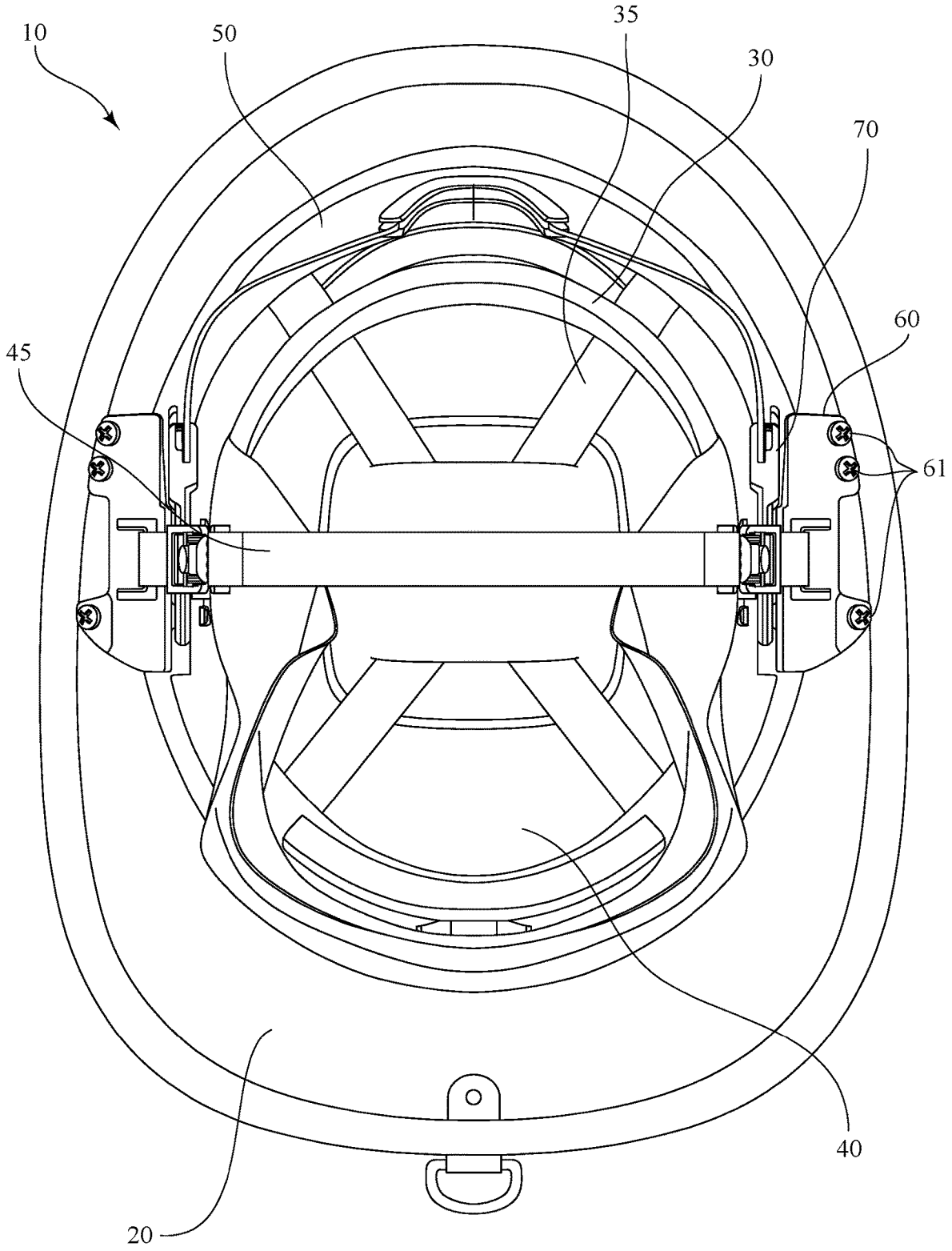
FIG. 3 is a bottom view of the exemplary protective helmet of FIG. 1.

FIGS. 1 and 2 are perspective views of an exemplary protective helmet 10 made in accordance with the present invention, and FIG. 3 is a bottom view of the protective helmet 10. As shown in FIGS. 1-3, the protective helmet 10 includes: a substantially rigid outer shell 20 shaped to protect the wearer's head, with the outer shell 20 defining a bottom opening and an internal cavity for receiving the wearer's head; a headband 30 positioned in the outer shell 20 near the bottom opening of the outer shell 20; and a suspension 35 comprised of at least two straps intersecting one another within the internal cavity of the outer shell 20. Such headbands and suspensions are well-known in the art and are further described, for example, in U.S. Pat. Nos. 6,609,254 and 7,174,575, which are incorporated herein by reference. The headband 30 and suspension 35 cooperate to reduce the potential for injury by maintaining a distance between the outer shell 20 and the head of the wearer and attenuating some translational energy of the force of an impact to the outer shell 20 of the helmet 10.

Referring still to FIGS. 1-3, in this exemplary embodiment, the protective helmet 10 further includes an inner shell 40 with a foam liner (shown in FIG. 3) positioned between the outer shell 20 and the suspension 35, which also aids in attenuating some translational energy of the force of an impact to the outer shell 20 of the helmet 10. Indeed, in this exemplary embodiment, the headband 30 and the straps of the suspension 35 are secured to the inner shell 20; however, in other embodiments, the headband 30 and/or the straps of the suspension 35 may be secured directly to the outer shell 20. In this exemplary embodiment, the protective helmet 10 also includes a chin strap 45 and an ear/neck protector 48. Finally, and of particular importance to the present invention, the protective helmet 10 includes a visor 50. In this regard, a visor 50 refers to and includes any form of face protection shield that covers any portion of the eyes and/or face of the wearer.

Figure 4:
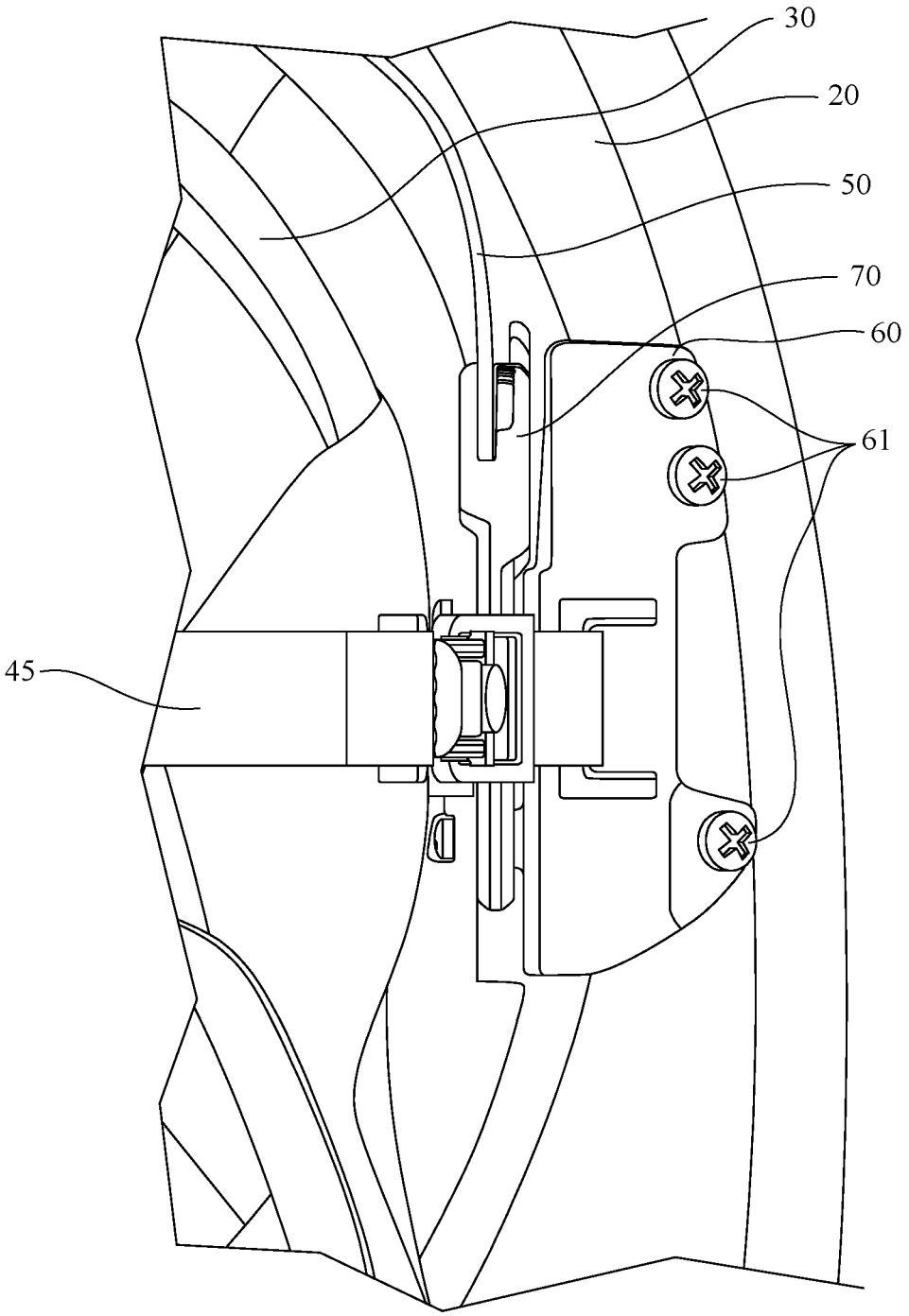
FIG. 4 is an enlarged partial bottom view of the exemplary protective helmet of FIG. 1, showing where one (left) side of the visor is secured to the outer shell of the protective helmet.

FIG. 4 is an enlarged partial bottom view of the exemplary protective helmet of FIG. 1, showing where one (left) side of the visor 50 is secured to the outer shell 20 of the helmet 10. Specifically, the visor 50 is secured by multiple components that not only secure the visor 50 to the outer shell 20 of the protective helmet 10, but allow the visor 50 to be readily moved from a retracted position within the outer shell 20 of the helmet 10 (i.e., a position between the outer shell 20 and the inner shell 40 in this exemplary embodiment) as shown in FIG. 2 to an extended position outside of the outer shell 20 and in front of the face of a wearer when the protective helmet is in use as shown in FIG. 1, or removed from the helmet 10 altogether. These components include: an anchor block 60, which is secured to the outer shell 20 of the protective helmet 10 by one or more screws or similar fasteners 61, with the anchor block 60 including a first cam 64 and a second cam 66, which each extend from a lateral surface of an upstanding wall portion 63 of the anchor block 60 (as further described below with respect to FIGS. 12-14); a retainer 70 including a groove 72 for receiving and retaining a portion of the visor 50, and further including first and second elongated slots 74, 76 (as further described below with respect to FIGS. 6 and 8-11) which define respective pathways for the first cam 64 and the second cam 66 of the anchor block 60; and a latch 80 which is pivotally mounted to the retainer 70 for selectively engaging the visor 50 (as further described below with respect to FIGS. 7-11). Each of these components and its respective interaction with the other components is described in further detail below. Furthermore, the opposite (right) side of the visor 50 is secured in the same manner to the opposite (right) side of the outer shell 20 of the protective helmet 10.

Figure 5:
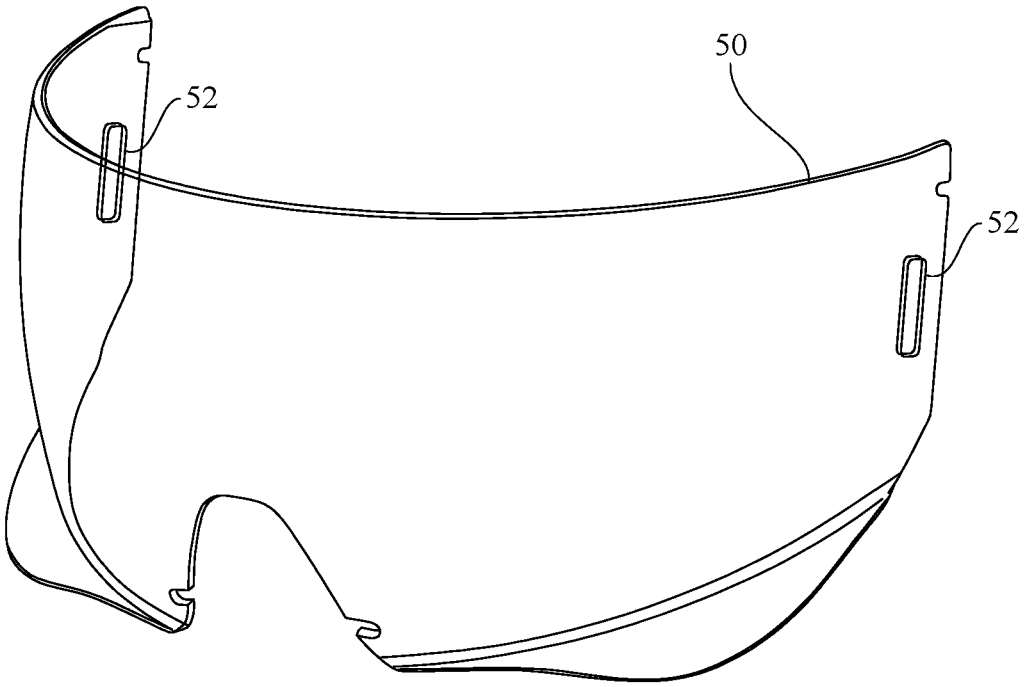
FIG. 5 is a perspective view of the visor of the exemplary protective helmet of FIG. 1.
Figure 6:
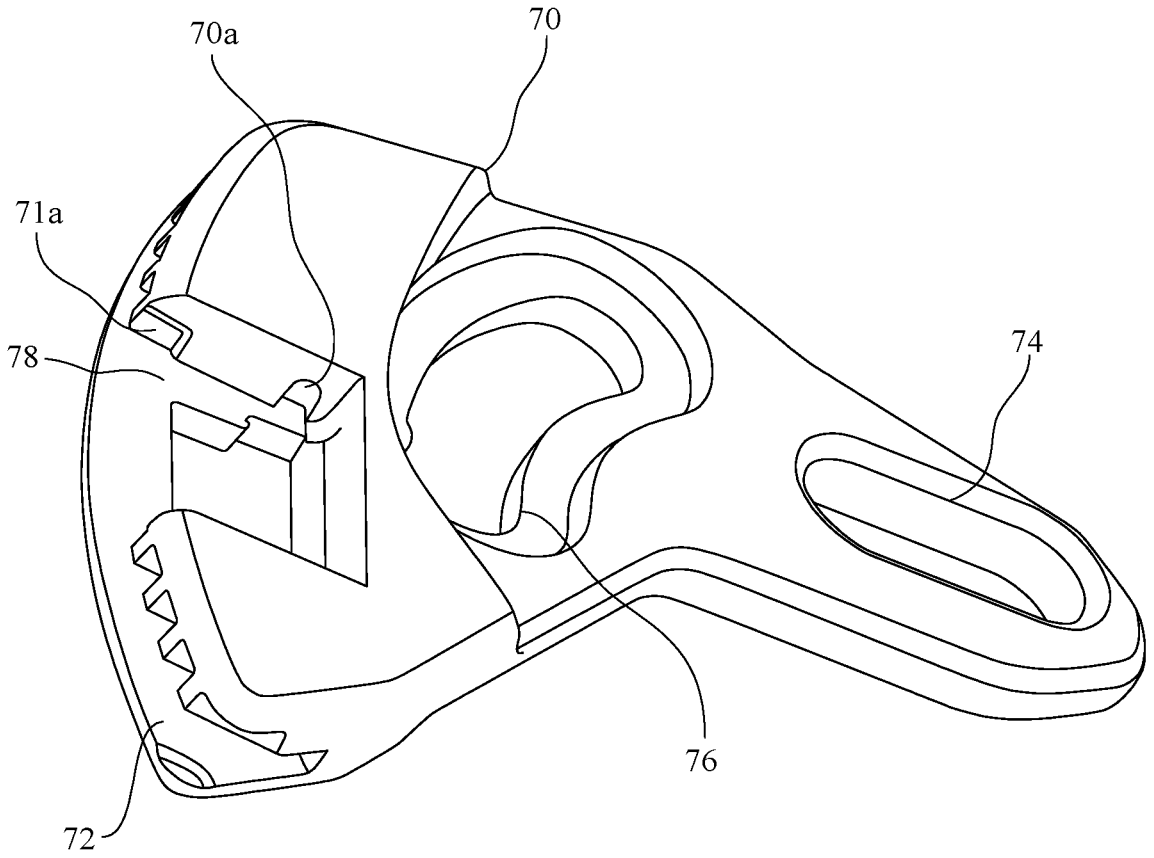
FIG. 6 is a perspective view of one of the retainers for receiving and retaining a portion of the visor of the exemplary protective helmet of FIG. 1.
Figure 7:
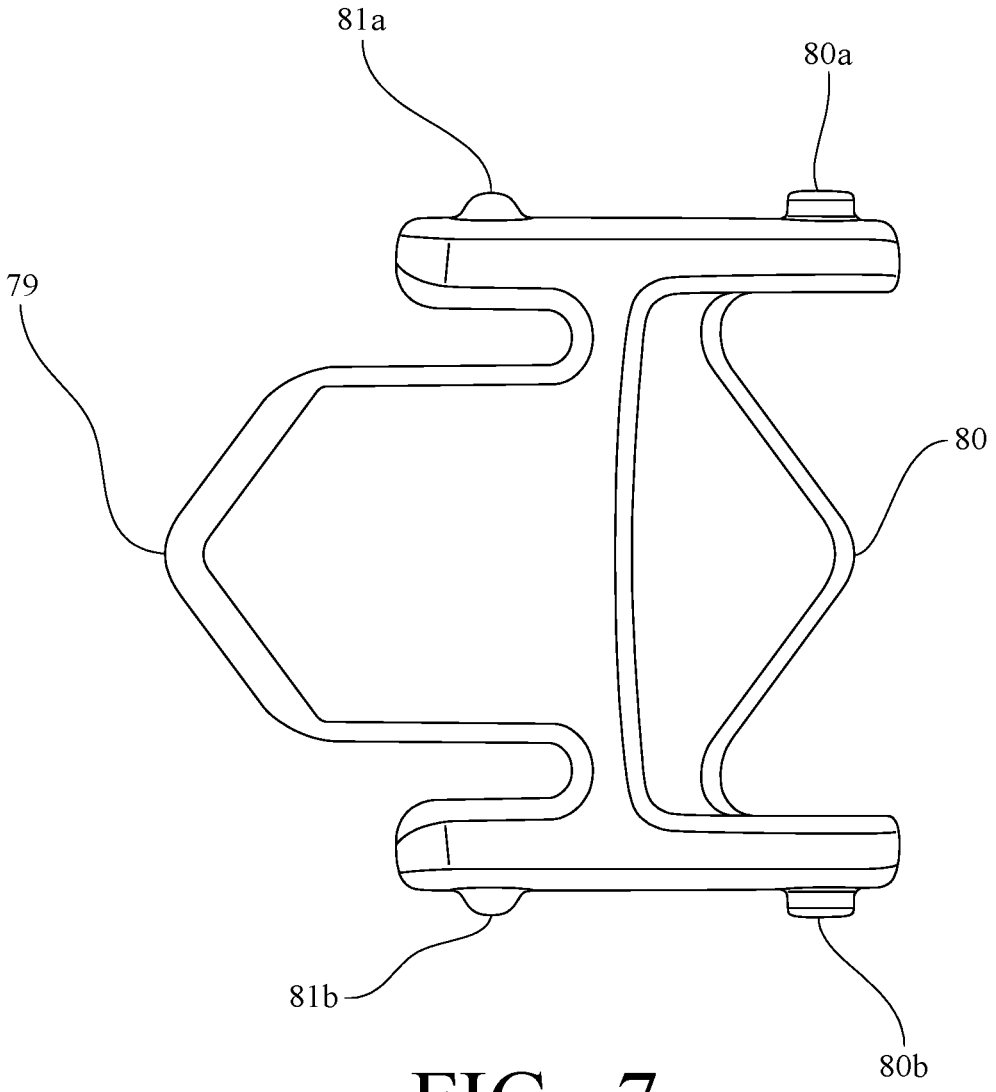
FIG. 7 is a plan view of a latch which is pivotally mounted to the retainer of FIG. 6 in the exemplary protective helmet of FIG. 1.

FIGS. 5-7 are, respectively, views of the visor 50, the retainer 70, and the latch 80 in isolation. As shown in FIG. 5, the visor includes slots 52 defined through the visor 50 near each of its side edges, the importance of which is described below.

Referring now to FIG. 6, and as mentioned above, the retainer 70 includes a groove 72, which is configured to receive a portion (i.e., a side edge) of the visor 50. The retainer 70 also includes an integral recess 78 for receiving the latch 80, as further described below. Finally, the retainer 70 includes first and second elongated slots 74, 76, which define respective pathways for the first cam 64 and the second cam 66 of the anchor block 60, as further described below.

Referring now to FIG. 7, the latch 80 includes two aligned bosses 80*a*, 80*b*. Furthermore, the latch 80 also includes upper and lower protrusions 81*a*, 81*b*.

Figure 8:
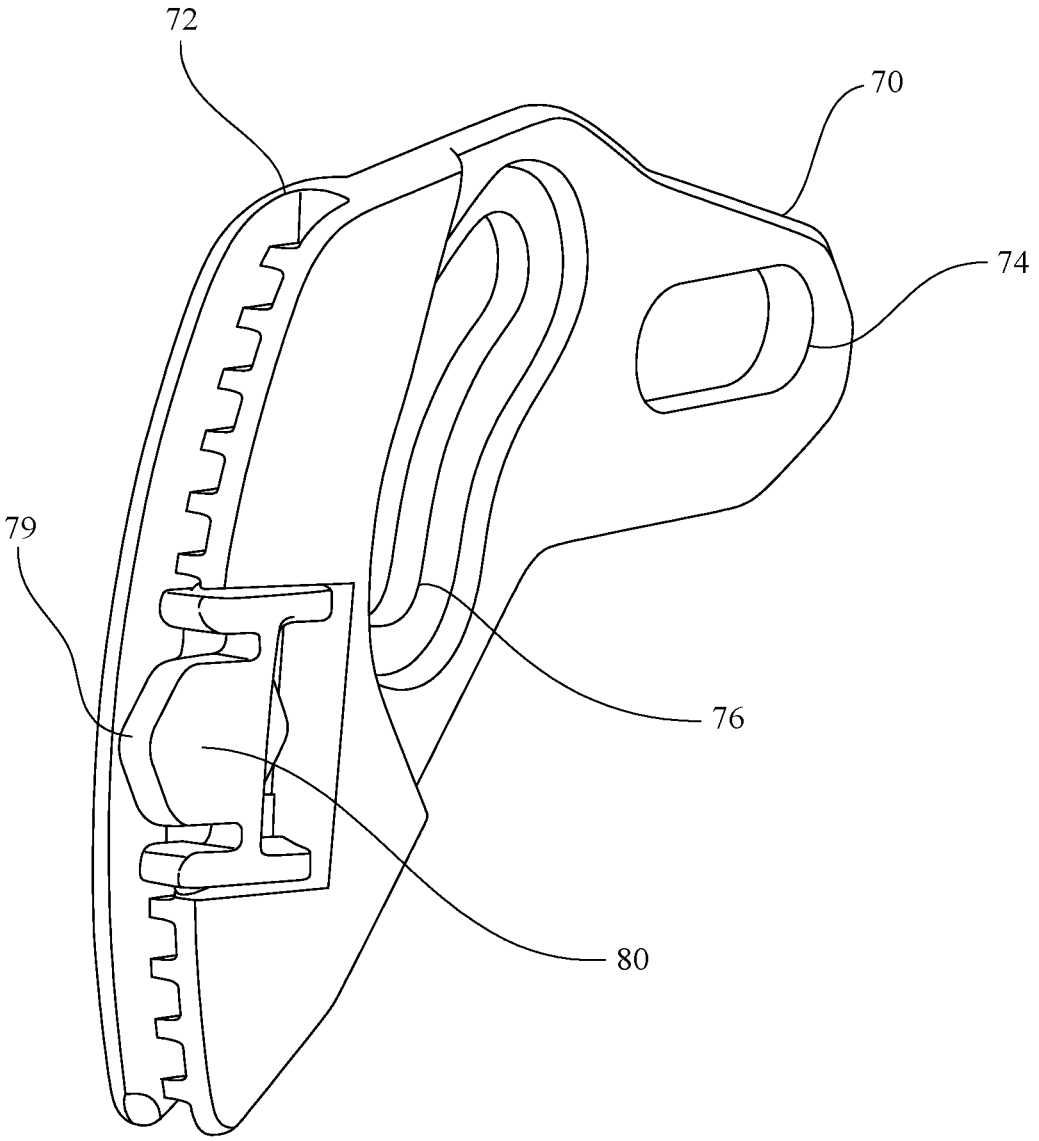
FIG. 8 is a perspective view of the retainer of FIG. 6 and the latch of FIG. 7 as assembled together in the exemplary protective helmet of FIG. 1.
Figure 9:
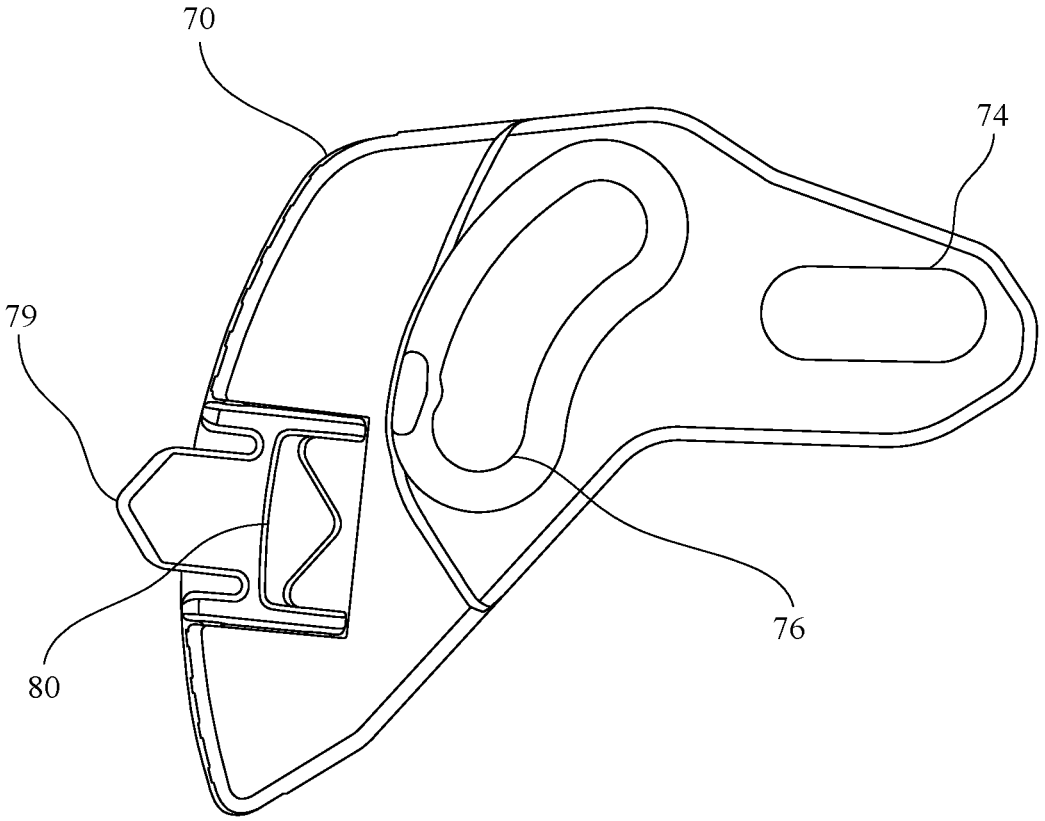
FIG. 9 is a plan view of the retainer of FIG. 6 and the latch of FIG. 7 as assembled together in the exemplary protective helmet of FIG. 1.

Referring still to FIGS. 6 and 7, along with the views of the retainer 70 and the latch 80 assembled together in FIGS. 8 and 9, with respect to the mounting of the latch 80 in the integral recess 78 of the retainer 70, the aligned bosses 80*a*, 80*b* of the latch are received in corresponding openings 70*a* (one which is visible in FIG. 6) defined in the retainer 70 on opposites sides of the integral recess 78. Thus, once the aligned bosses 80*a*, 80*b* of the latch 80 are positioned in the openings 70*a* defined in the retainer 70, the latch 80 can pivot with respect to the retainer 70 about a pivot axis defined by the aligned bosses 80*a*, 80*b*. Furthermore, the upper and lower protrusions 81*a*, 81*b* of the latch 80 are received in corresponding notches 71*a* (one which is visible in FIG. 6) defined in the retainer 70. However, these upper and lower protrusions 81*a*, 81*b* are only intended to lock the latch 80 in a closed position through frictional engagement, as shown, for example, in FIG. 8. However, by applying a force to the edge 79 of the latch 80 (i.e., pulling it), the frictional force is overcome, and the latch 80 can be again pivoted about the pivot axis defined by the aligned bosses 80*a*, 80*b* into an open position.

Figure 10:
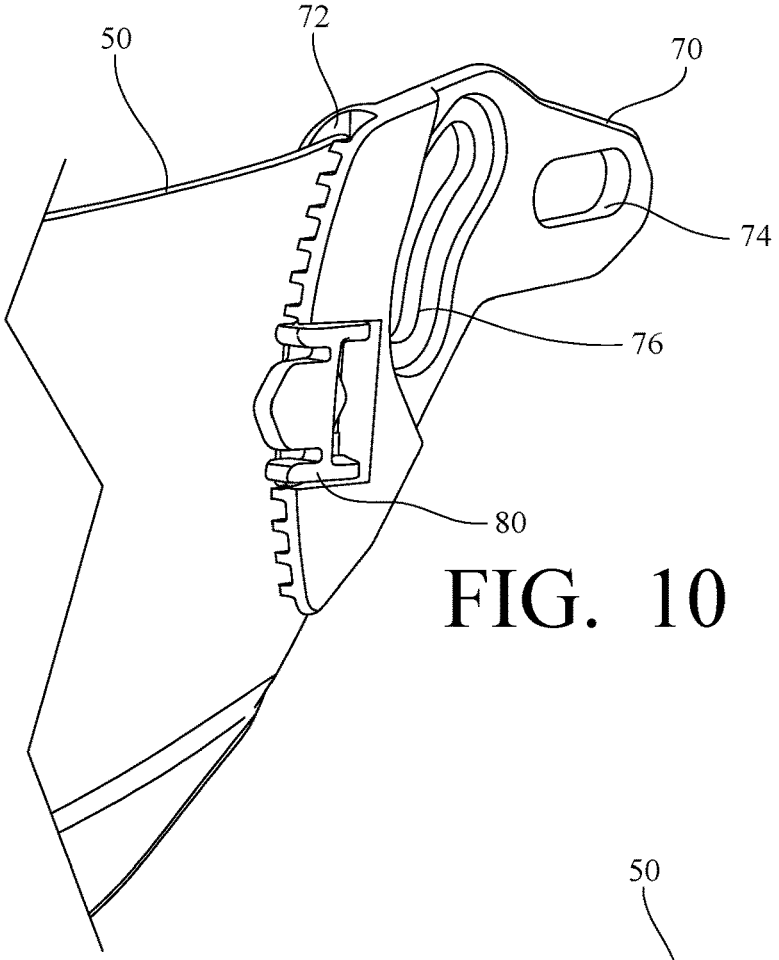
FIG. 10 is a perspective view of the retainer of FIG. 6 and the latch of FIG. 7 as assembled together in the exemplary protective helmet of FIG. 1, in which a portion of the visor of FIG. 1 is received and retained in a groove defined by the retainer, with the latch engaging the visor.
Figure 11:
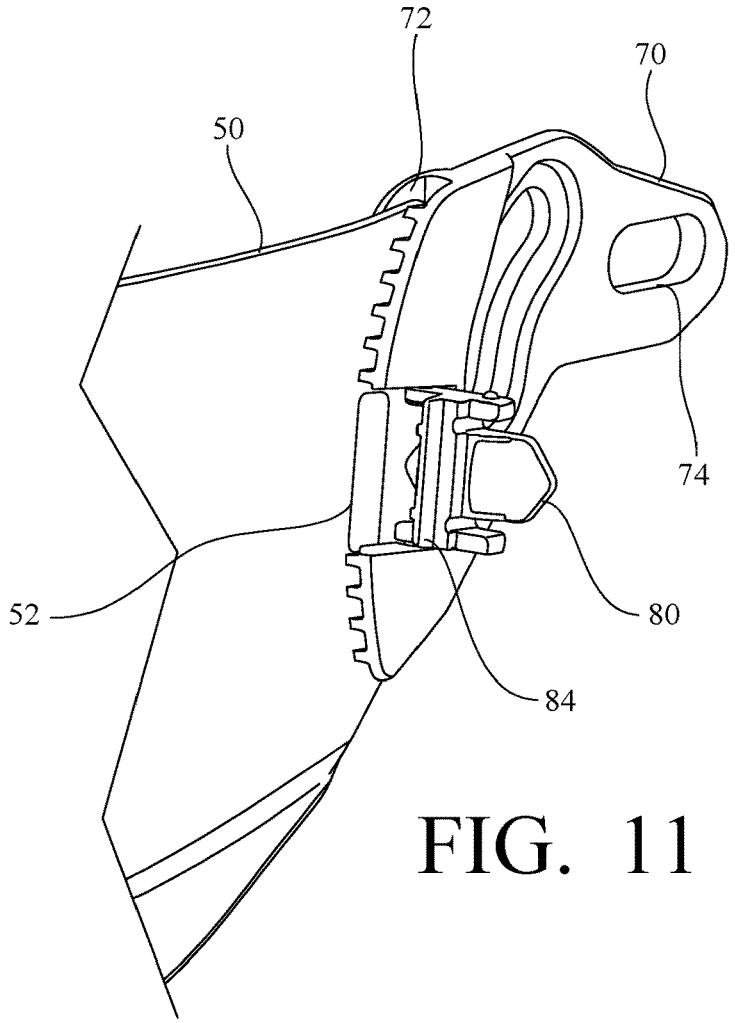
FIG. 11 is a perspective view similar to FIG. 10, but with the latch pivoted out of engagement with the visor.

FIG. 10 is a perspective view of the retainer 70 and the latch 80 as assembled, in which a portion of the visor 50 is received and retained in the groove 72 defined by the retainer 70, with the latch 80 engaging the visor 50. FIG. 11 is a perspective view similar to FIG. 10, but with the latch 80 pivoted out of engagement with the visor 50. As shown in FIG. 11, the latch 80 also includes an integral ridge 86 extending from its rear surface. As described above with respect to FIG. 5, the visor includes slots 52 defined through the visor 50 near each of its side edges. Referring again to FIG. 11, when the latch 80 is in the closed position, the integral ridge 86 extending from the rear surface of the latch 80 is positioned in the slot 52 defined through the visor 50 near its side edge. Thus, when the latch 80 is in the closed position, the visor 50 is locked into position within the groove 72 defined by the retainer 70, as shown in FIG. 10. However, when the latch 80 is pivoted out of engagement with the visor 50 (i.e., the integral ridge 86 is withdrawn from the slot 52 defined through the visor 50) into an open position, as shown in FIG. 11, the visor 50 can be withdrawn from the groove 72 and removed from the retainer 70.

Figure 12:
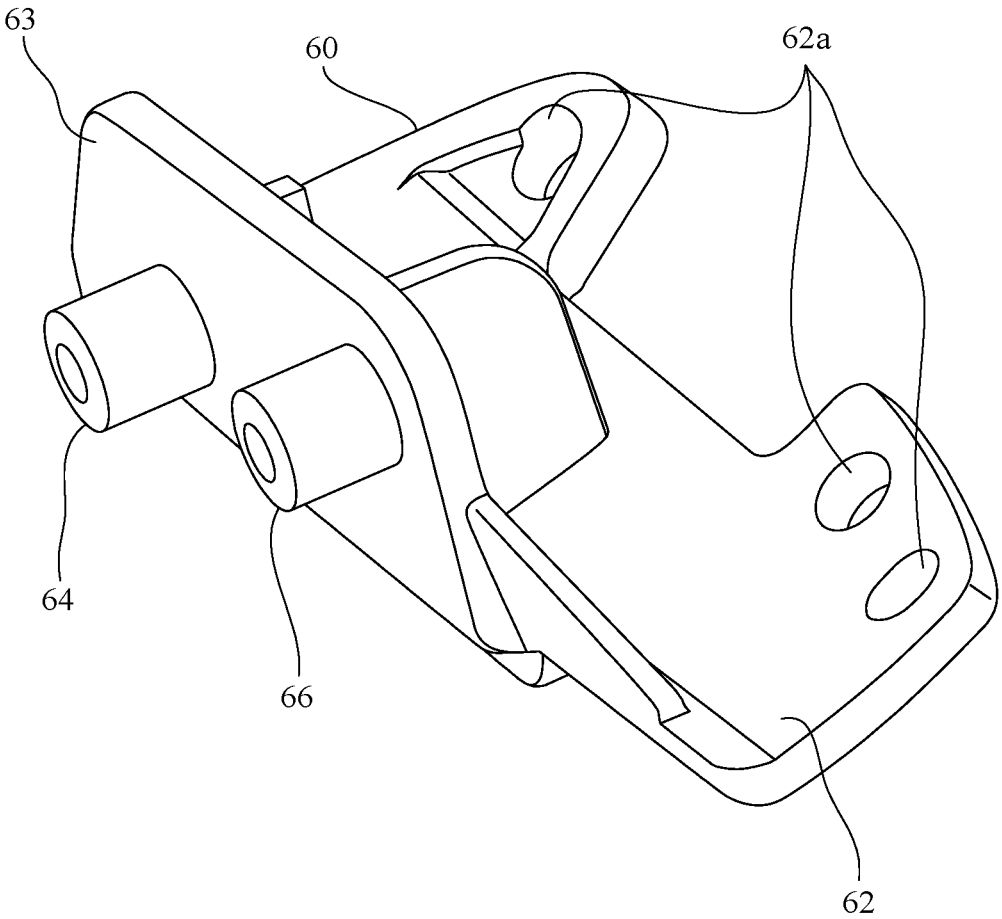
FIG. 12 is a perspective view of the anchor block in the exemplary protective helmet of FIG. 1.

FIG. 12 is a perspective view of the anchor block 60. The anchor block 60 includes a central body portion 62, with one or more holes 62*a* defined therethrough. Referring again to FIGS. 1 and 2, the anchor block 60 is secured to the outer shell 20 of the protective helmet 10 by fasteners 61 that pass through the holes 62*a*.

Figure 13:
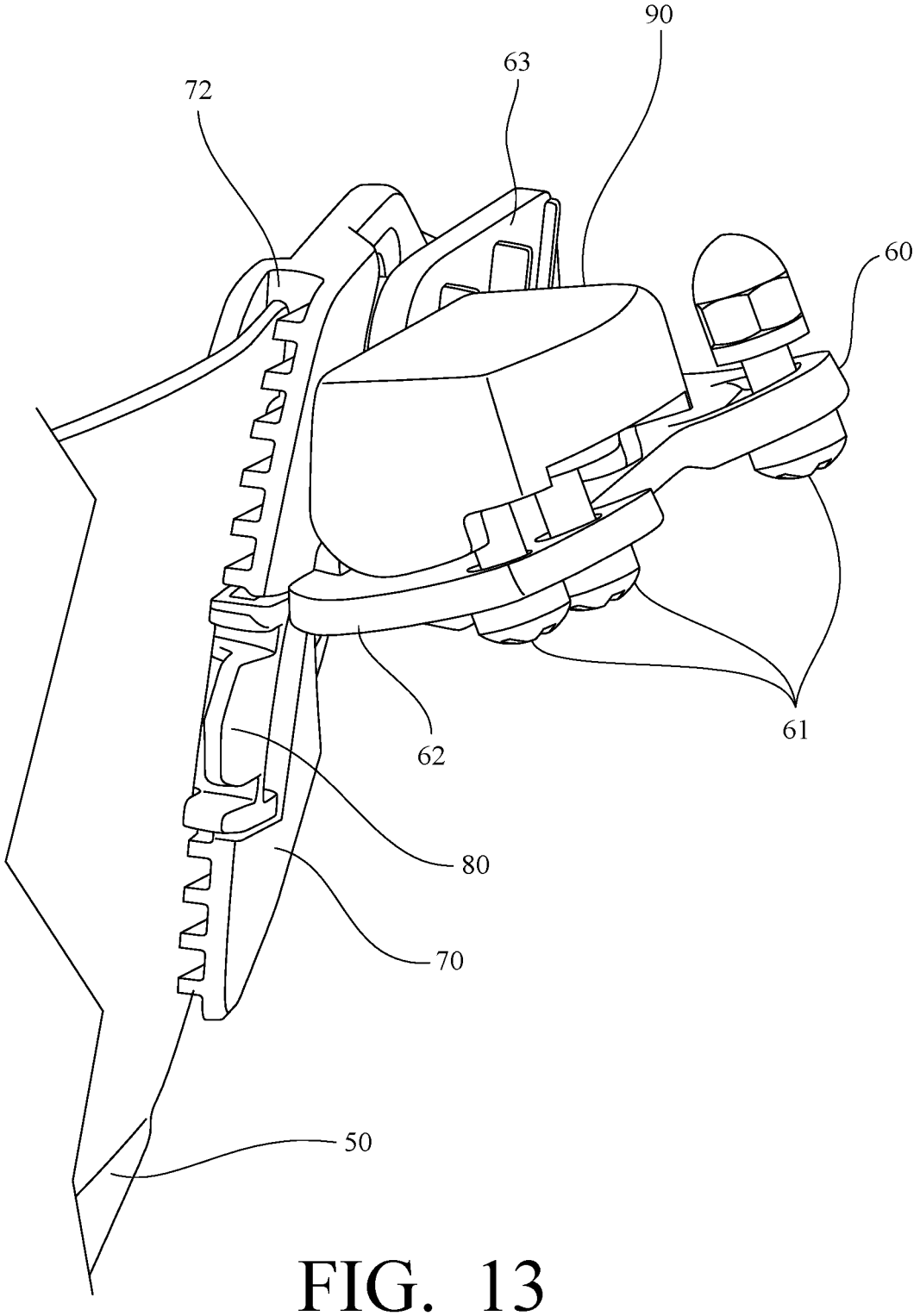
FIG. 13 is a perspective view of the anchor block as connected to a bracket which would be positioned on the opposite side of the brim of the outer shell in the exemplary protective helmet of FIG. 1.

FIG. 13 is a perspective view of the anchor block 60 as connected to a bracket 90 which would be positioned on the opposite side of the brim of the outer shell 20. In FIG. 13, however, for purposes of illustrating the connection between the anchor block 60 and the bracket 90, the outer shell 20 has been removed. As shown, in this exemplary embodiment, certain of the fasteners 61 that are used to secure the anchor block 60 to the outer shell 20 of the protective helmet 10 are threaded into the bracket 90 to ensure that the anchor block 60 is securely fastened to the outer shell 20. However, it should be recognized that, in other embodiments, the anchor block 60 may be secured directly to the outer shell 20 of the protective helmet 10. In such cases, the bracket 90 is unnecessary.

Referring again to FIG. 12, the anchor block 60 also includes an upstanding wall portion 63, with the first cam 64 and the second cam 66 each extending from a lateral surface of the upstanding wall portion 63 of the anchor block 60.

Figure 14:
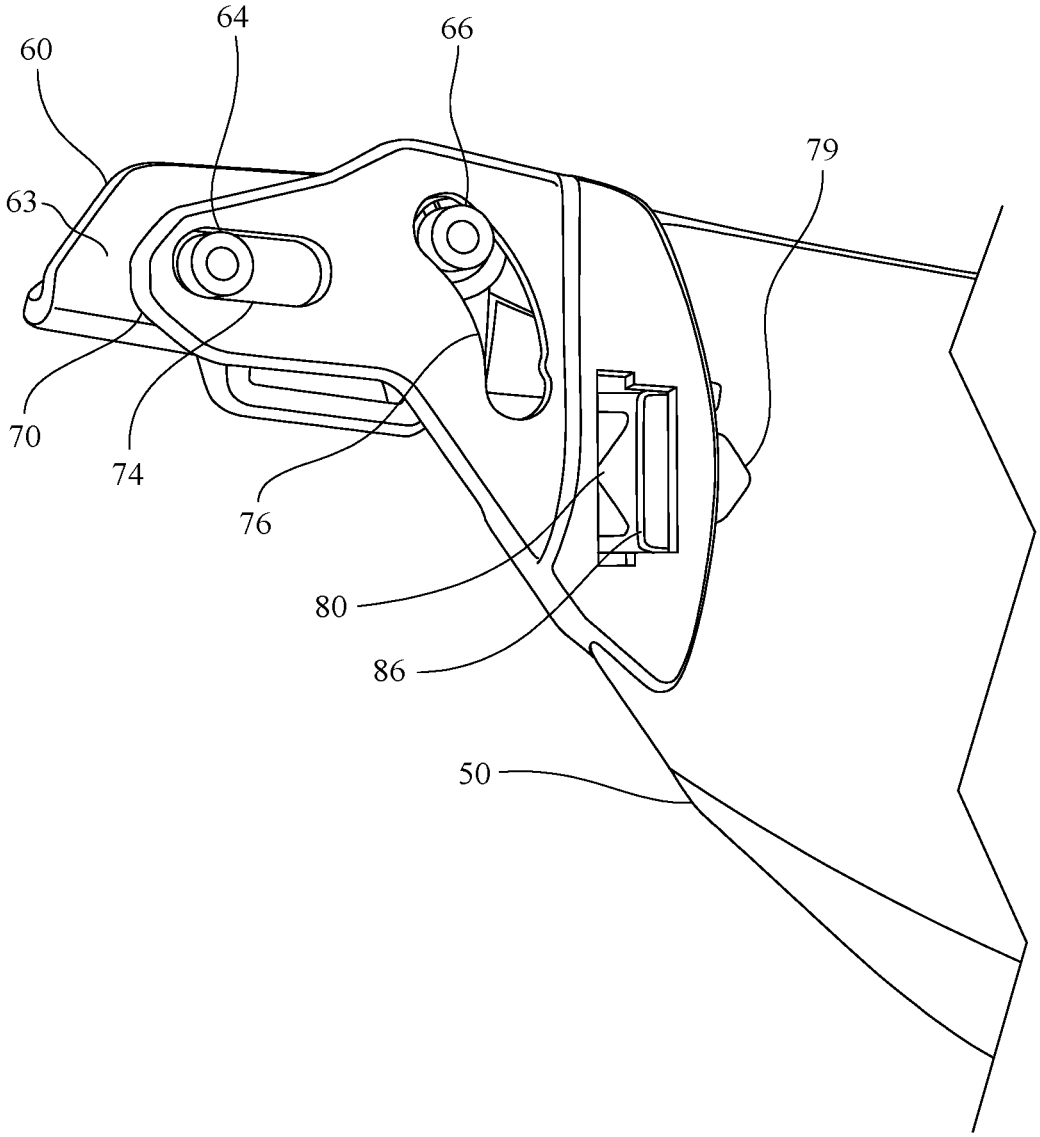
FIG. 14 is a perspective view of the retainer of FIG. 6 and the latch of FIG. 7 as assembled to the anchor block of FIG. 12 in the exemplary protective helmet of FIG. 1.

FIG. 14 illustrates the same components as FIG. 13, but viewing the assembly from the opposite side (i.e., from inside of the protective helmet 10). As shown in FIG. 14, the first cam 64 extending from the lateral surface of the upstanding wall portion 63 of the anchor block 60 is received in the first elongated slot 74 of the retainer 70. Similarly, the second cam 66 extending from the lateral surface of the upstanding wall portion 63 of the anchor block 60 is received in the second elongated slot 76 of the retainer 70. Since the position of the anchor block 60 is fixed relative to the outer shell 20 of the protective helmet 10, the interaction of the respective first and second cams 64, 66 with the corresponding first and second elongated slots 74, 76 controls movement of the retainer 70, and thus the visor 50, with respect to the outer shell 20 of the protective helmet 10. Specifically, when the visor 50 is in the retracted position within the outer shell 20 of the protective helmet 10, the first cam 64 would be positioned at a right end of the first elongated slot 74 that is proximal to the visor 50, and the second cam 66 would be positioned at a lower end of the second elongated slot 76 that is proximal to the visor 50. To move the visor 50 into an extended position in front of the face of the wearer, the wearer grasps the edge of the visor 50 and pulls it down. As a result of the interaction of the respective first and second cams 64, 66 with the corresponding first and second elongated slots 74, 76, the visor 50 rotates downward and forward, away from the face of the wearer, with the first cam 64 now positioned at a left end of the first elongated slot 74 that is distal to the visor 50, and the second cam 66 positioned at an upper end of the second elongated slot 76 that is distal to the visor 50, as shown in FIG. 14. The visor 50 is now in a forwardmost position relative to the outer shell 20.

As mentioned above, the opposite (right) side of the visor 50 is secured in the same manner to the opposite (right) side of the outer shell 20 of the protective helmet 10. Thus, the visor 50 can be characterized as rotating simultaneously about a first pivot axis defined by the aligned first cams 64 on the left and right sides of the protective helmet 10 and a second pivot axis defined by the aligned second cams 66 on the left and right sides of the protective helmet 10 as the visor 50 moves between the retracted position and the extended position. Because of this rotation along two axes, when it is rotated from the retracted position to the extended position, the visor 50 is effectively extended forward (away from the face) before it drops down (in front of the face). Thus, the visor 50 can be used over and in front of glasses, goggles, or other eye protection that may also be used by the wearer.

Additionally, because the visor 50 can be readily removed by pivoting the latches 80 out of engagement with the visor 50, as described above with respect to FIG. 11, the visor 50 can be easily replaced should it become damaged.

One of ordinary skill in the art will recognize that additional embodiments and implementations are also possible without departing from the teachings of the present invention. This detailed description, and particularly the specific details of the exemplary embodiments and implementations disclosed therein, is given primarily for clarity of understanding, and no unnecessary limitations are to be understood therefrom, for modifications will become obvious to those skilled in the art upon reading this disclosure and may be made without departing from the spirit or scope of the invention.

What is claimed is:

1. A protective helmet adapted to receive and protect a head of a wearer, comprising:

an outer shell shaped to protect the head of the wearer, with the outer shell defining a bottom opening and an internal cavity for receiving the head of the wearer;

a headband and a suspension positioned within the internal cavity of the outer shell;

a visor rotatable between a retracted position within the outer shell to an extended position outside of the outer shell, wherein the visor simultaneously rotates about a first pivot axis and a second pivot axis and moves downward and forward relative to the outer shell as the visor moves from the retracted position to the extended position;

a first cam positioned on the outer shell;

a second cam positioned on the outer shell;

a retainer receiving and retaining a portion of the visor, the retainer including a first slot defining a pathway for the first cam and including an end distal to the visor, a second slot defining a pathway for the second cam and including an end distal to the visor, and a groove for receiving and retaining the portion of the visor;

an anchor block secured to the outer shell on one side of the protective helmet, wherein the anchor block includes the first cam and the second cam; and a latch pivotally mounted to the retainer for selectively engaging the visor, such that, when the latch is in a closed position, the visor is locked into position in the groove of the retainer, but, when the latch is in an open position, the visor can be withdrawn from the groove;

wherein the end distal to the visor of the first slot approaches the first cam as the visor moves forward from the retracted position to the extended position, and the end distal to the visor of the second slot approaches the second cam as the visor moves downward from the retracted position to the extended position; and wherein the latch includes an integral ridge extending from a surface thereof, such that, when the latch is in the closed position, the integral ridge is received in a slot defined through the visor, but when the latch is in the open position, the integral ridge is disengaged from the visor.

2. The protective helmet as recited in claim 1, wherein the anchor block includes an upstanding wall portion, with the first cam and the second cam each extending from a lateral surface of the upstanding wall portion of the anchor block.

3. The protective helmet as recited in claim 1, wherein the visor is in a forwardmost position relative to the outer shell when the end distal to the visor of the first slot reaches the first cam and the end distal to the visor of the second slot reaches the second cam.

4. A protective helmet adapted to receive and protect a head of a wearer, comprising:

an outer shell shaped to protect the head of the wearer, with the outer shell defining a bottom opening and an internal cavity for receiving the head of the wearer;

an inner shell secured to the outer shell and positioned within the internal cavity of the outer shell;

a visor;

a headband and a suspension positioned within the internal cavity of the outer shell and secured to the inner shell;

a first anchor block secured to the outer shell on one side of the protective helmet, with the first anchor block including a first cam and a second cam;

a first retainer including first and second elongated slots which define respective pathways for the first cam and the second cam of the first anchor block, such that movement of the first retainer relative to the first anchor block is controlled by the interaction of the first cam and the second cam of the first anchor block with the first and second elongated slots of the first retainer, and wherein the first retainer includes a groove for receiving and retaining a portion of the visor;

a second anchor block secured to the outer shell on an opposite side of the protective helmet, with the second anchor block also including a first cam and a second cam;

a second retainer including first and second elongated slots which define respective pathways for the first cam and the second cam of the second anchor block, such that movement of the second retainer relative to the second anchor block is controlled by the interaction of the first cam and the second cam of the second anchor block with the first and second elongated slots of the second retainer, and wherein the second retainer includes a groove for receiving and retaining another portion of the visor;

a first latch pivotally mounted to the first retainer for selectively engaging the visor, such that, when the first latch is in a closed position, the visor is locked into position in the groove of the first retainer, but, when the first latch is in an open position, the visor can be withdrawn from the groove; and a second latch pivotally mounted to the second retainer for selectively engaging the visor, such that, when the second latch is in a closed position, the visor is locked into position in the groove of the second retainer, but, when the second latch is in an open position, the visor can be withdrawn from the groove;

wherein the visor is rotatable between a retracted position between the outer shell and the inner shell to an extended position outside of the outer shell via movement of the first retainer relative to the first anchor block and movement of the second retainer relative to the second anchor block;

wherein the visor simultaneously moves downward and forward relative to the outer shell as the visor moves from the retracted position to the extended position;

wherein the first latch includes an integral ridge extending from a surface thereof, such that, when the first latch is in the closed position, the integral ridge is received in a first slot defined through the visor, but when the first latch is in the open position, the integral ridge is disengaged from the visor; and wherein the second latch also includes an integral ridge extending from a surface thereof, such that, when the second latch is in the closed position, the integral ridge is received in a second slot defined through the visor, but when the second latch is in the open position, the integral ridge is disengaged from the visor.

* * * * *